United States Patent [19]

Bastian

[11] 3,948,454

[45] Apr. 6, 1976

[54] DISPENSER FOR MULTIPLE ROLLS OF SHEET MATERIAL

[75] Inventor: Lehyman John Bastian, Media, Pa.

[73] Assignee: Scott Paper Company, Philadelphia, Pa.

[22] Filed: Dec. 3, 1974

[21] Appl. No.: 529,071

[52] U.S. Cl. ..... 242/55.3; 221/10; 312/39; 242/55.53

[51] Int. Cl.[2] ..... B65H 19/00

[58] Field of Search ..... 221/9, 10, 17, 312 R, 243, 221/276, 260, 151, 152; 242/55.3, 55.53; 312/38, 39

[56] References Cited

UNITED STATES PATENTS

| | | | |
|---|---|---|---|
| 827,248 | 7/1906 | Martin | 221/260 X |
| 3,058,682 | 10/1962 | Mott et al. | 242/55.3 |
| 3,650,487 | 3/1972 | Bahnsen | 312/39 X |
| 3,771,739 | 11/1973 | Nelson | 242/55.3 |

*Primary Examiner*—Robert B. Reeves
*Assistant Examiner*—Joseph J. Rolla
*Attorney, Agent, or Firm*—R. D. Vickrey; W. J. Foley

[57] ABSTRACT

Disclosed is an apparatus for dispensing sheet material such as bathroom tissue from a roll. The apparatus includes a cabinet having a dispensing zone from where the sheet material may be removed first from a primary roll and later from a reserve roll. The cabinet also has a storage zone where at least one reserve roll of sheet material is stored for use after depletion of the sheet material on the primary roll. A first spindle for holding the primary roll is attached to the cabinet in the dispensing zone, and a second spindle for holding the reserve roll is attached to the cabinet and is movable from the storage zone to the dispensing zone. The apparatus includes a holding element for holding the second spindle in the storage zone until depletion of the sheet material on the primary roll. The apparatus further includes a release member for releasing the holding element, preferably automatically, only upon depletion of the sheet material on the primary roll. Upon release of the holding element, the second spindle drops from the storage zone to the dispensing zone.

13 Claims, 3 Drawing Figures

DISPENSER FOR MULTIPLE ROLLS OF SHEET MATERIAL

BACKGROUND OF THE INVENTION

1. Field of the Invention

The invention relates to a dispenser for dispensing sheet material on a roll, such as bathroom tissue and other sanitary paper products. More particularly, the invention relates to a dispenser having a reserve roll which can be brought into position for dispensing only when the primary roll has been substantially exhausted.

2. Description of the Prior Art

The advantages of multi-roll dispenser, particularly for such uses as dispensing bathroom tissue in commercial establishments, are well recognized. Because it is impractical for bathroom attendants to frequently check the tissue supply in the dispensers, it is desirable to have a reserve roll of tissue kept with the primary roll being used. Unfortunately, pilfering of the reserve roll occasionally results when it is left unattached to the dispenser.

A number of inventors have turned their attention to this problem and have developed dispensers which hold the reserve roll in an enclosed storage zone to prevent pilfering. But these prior art dispensers have certain disadvantages. For example, many of them do not prevent the user from dropping the reserve roll into the dispensing position before the first roll is depleted, an action resulting in the bathroom attendant often finding both the primary roll and the reserve roll partially depleted. The attendant must then replace at least one of the unexhausted rolls. Also, many of the prior art dispensers use special spindles requiring modifications to the tissue or core of the rolls, and others use spindles which are removable from the dispensers and are subject to being lost or pilfered.

In view of these disadvantages, it is an object of the invention to provide a dispenser which will transfer a reserve roll of bathroom tissue from an enclosed storage zone to a dispensing zone only when the primary roll has been substantially exhausted. It is a further object of the invention in its preferred embodiment to provide a dispenser which does not use spindles that are removable from the dispenser and subject to becoming lost. And, it is an additional object of the invention in its preferred embodiment to provide a dispenser in which tissue can be placed without modifications to the tissue or core of the rolls.

SUMMARY OF THE INVENTION

The present invention is a dispenser for dispensing sheet material such as bathroom tissue in roll form. The dispenser consists of a cabinet having a dispensing zone from where sheet material may be removed from a primary roll and of a storage zone in which at least one reserve roll of sheet material is stored for use after depletion of the material on the primary roll. The storage zone of the cabinet is sufficiently enclosed to prevent removal of sheet material from a roll while it is in the storage zone. The dispenser in its preferred form has a first spindle permanently attached to the cabinet, preferably in a fixed position, in the dispensing zone for holding the primary roll of sheet material and a second spindle attached to the dispenser for holding a reserve roll of the sheet material. The second spindle is movable from a first position in the storage zone to a second position in the dispensing zone upon release of holding means. The holding means are released, preferably automatically, by release means upon depletion of the material on the first spindle, and cannot be released before.

The first position in the storage zone is preferably above the second position in the dispensing zone so that the second spindle is moved from the first position to the second by gravity. The spindles are designed to accommodate bathroom tissue, or other roll products, on unmodified cores. Both spindles are secured to the cabinet and are not subject to being lost or pilfered.

The invention in its preferred form also includes additional features to permit manual actuation of the release means after the primary roll is substantially depleted and a cabinet cover which cooperates with the holding means to permit convenient repositioning of the spindle in the storage zone.

DESCRIPTION OF THE PREFERRED EMBODIMENT

The apparatus of the invention can be used for dispensing many forms of sheet material in a roll, but it will be described herein in its preferred use of dispensing bathroom tissue. The apparatus includes a dispensing cabinet 1 which is box-like and has a top, back, sides and front cover 2. The front cover 2 is connected to the top of the cabinet 1 through hinge 3 to permit opening the cabinet for replacing bathroom tissue. The upper portion of the cabinet 1 forms a storage zone which is sufficiently enclosed to prevent access to the reserve roll of bathroom tissue. The lower portion of the cabinet 1 is generally open, forming a dispensing zone where bathroom tissue can be removed from the primary roll and also from the reserve roll when it has moved into the dispensing zone.

Figure 2:
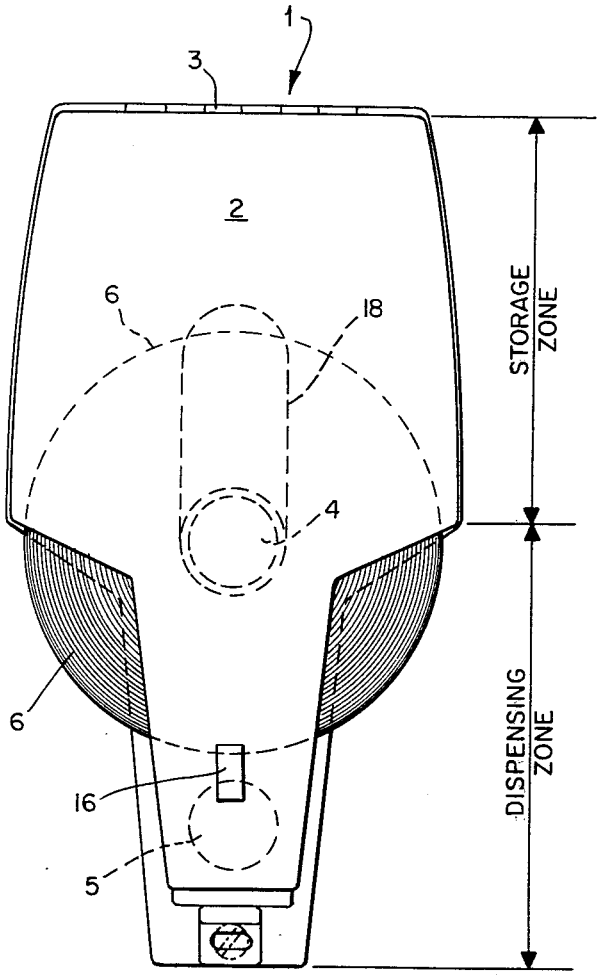
FIG. 2 is a front elevation view of the preferred apparatus of the invention, illustrating an exhausted primary roll and the reserve roll in the dispensing zone of the cabinet.
Figure 1:
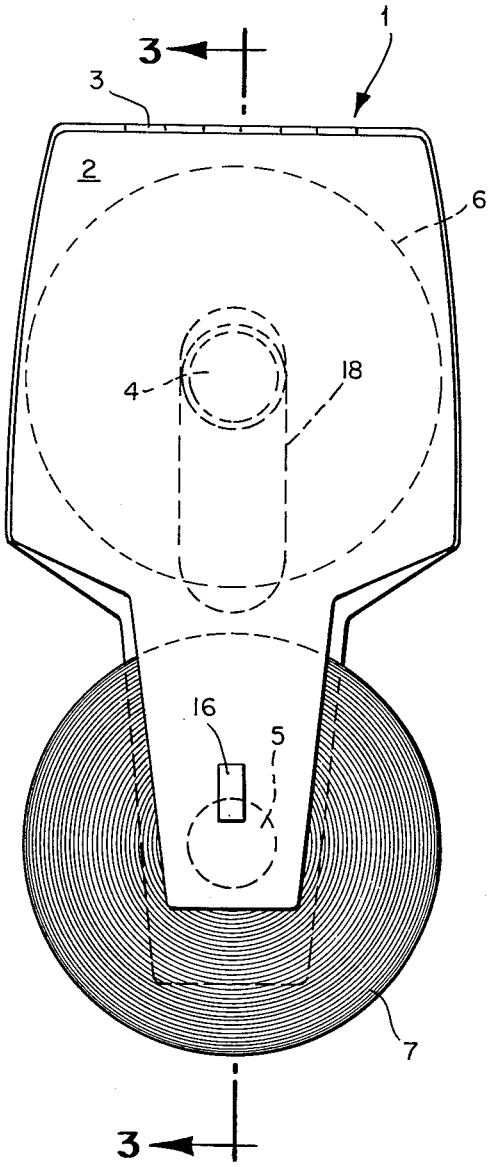
FIG. 1 is a front elevation view of the preferred apparatus of the invention, illustrating the reserve roll in the storage zone of the cabinet.
Figure 3:
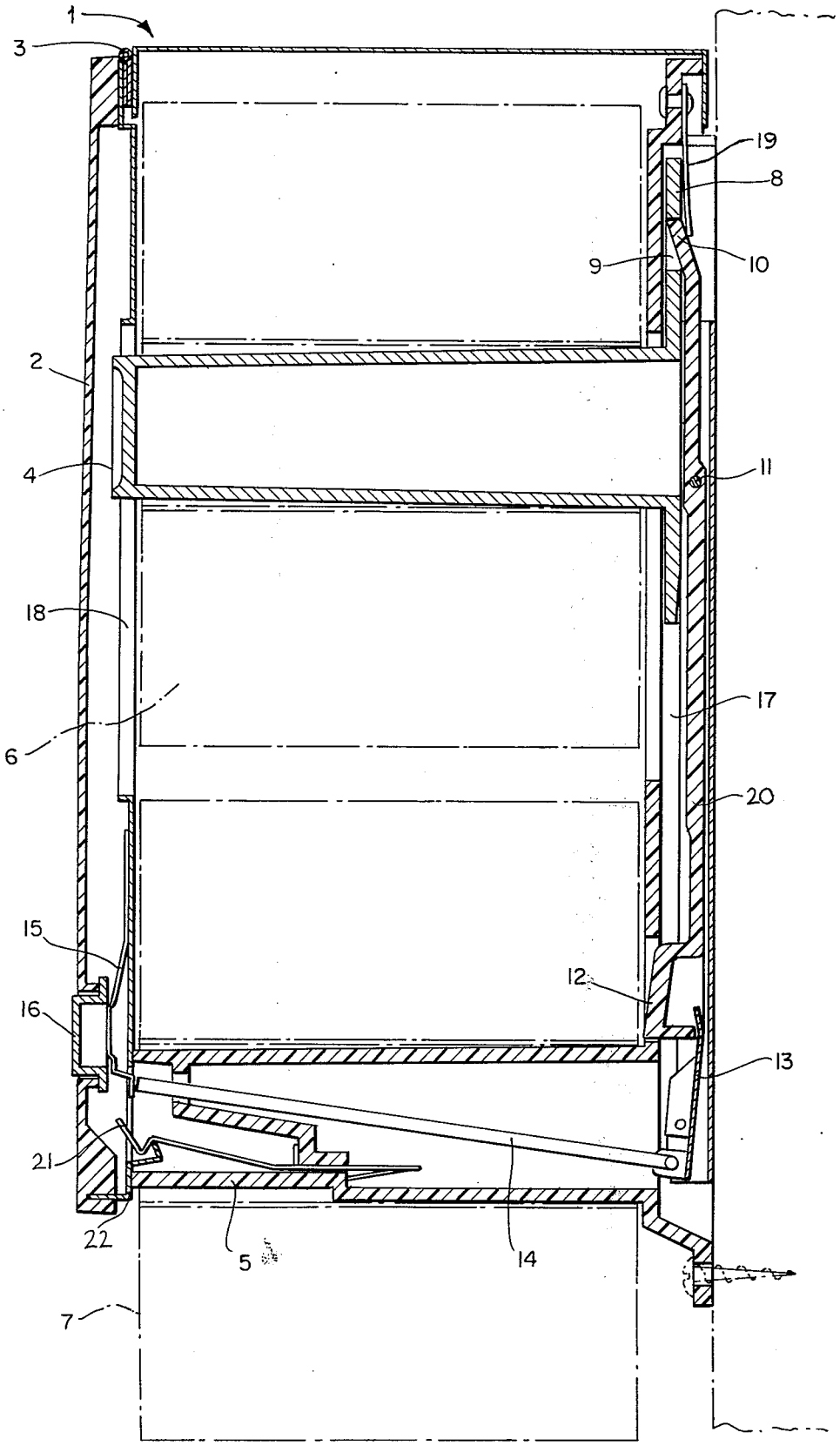
FIG. 3 is a cut-away view taken along line 3—3 in FIG. 1.

Referring to FIG. 3, the preferred embodiment of the invention includes the reserve roll spindle 4 and the primary roll spindle 5, both attached to the cabinet 1. The primary roll spindle is preferably permanently attached to the cabinet in a fixed position in the dispensing zone. The reserve roll spindle 4 includes a flange 8 at the rear of the spindle 4. The flange 8 is slideably mounted in a spindle flange channel 17 adjacent the back of the cabinet 1. The forward wall forming spindle flange channel 17 includes a vertical slot which guides the reserve roll spindle 4 from its first position in the storage zone to its second position in the dispensing zone. The vertical slot is narrower than the reserve roll spindle flange 8, and it prevents the reserve roll spindle 4 from being removed from the dispenser 1. Assisting in guiding reserve roll spindle 4 is vertical slot 18 in the inner wall of cover 2.

The holding means for holding the reserve roll spindle 4 in the storage zone are provided by a lever arm 20 which is pivotably connected to the cabinet through lever pivot 11. The upper end of lever arm 20 includes latch 10 which engages notch 9 in reserve roll spindle flange 9. At the lower end of the lever arm 20 is lever arm nob 12 protruding toward the front of cabinet 1 for engagement against the side of the sheet material on primary roll 7. Lever arm nob 12 is designed to engage the end of the bathroom tissue roll 7 (shown in phantom lines) and is prevented from forward movement by the paper on the roll until the paper is substantially exhausted. As long as lever arm knob 12 is prevented from forward movement, latch 10 remains engaged in flange notch 9 and prevents reserve roll spindle 4 from being dropped into the dispensing zone.

Upon exhaustion of the paper in primary roll 7, lever arm knob 12 is permitted to move forward, causing the lever arm 20 to pivot about latch lever pivot 11 and disengage latch 10 from flange notch 9. Reserve roll spindle 4 then drops into the dispensing zone with the reserve roll spindle flange 8 being guided by spindle flange channel 17. When the lower portion of lever arm 20 moves forward, it slows the fall of reserve roll spindle 4 by yieldingly blocking the spindle flange channel 17.

The lever arm knob 12 is biased forwardly towards the end of primary roll 7 by spring 15 acting through push rod 14 and pivotably mounted push rod arm 13. Push rod 14 passes through the inside of primary roll spindle 5 so that it does not interfere with the primary roll 7 of sheet material. A release button 16 mounted in cabinet cover 2 adjacent spring 15 permits application of additional force on push rod 14 if manual actuation of the lever arm is desired or found necessary. However, as long as a substantial portion of bathroom tissue remains on primary roll 7, manual dropping of reserve roll spindle 4 cannot be actuated.

Having described the preferred embodiment of the invention, its operation will be briefly described. When servicing the bathroom tissue dispenser of the invention, the attendant opens cabinet cover 2 and removes the empty roll core from primary roll spindle 5, replacing it with the partially used reserve roll from spindle 4. Lever arm knob 12 swings rearwardly about latch lever pivot 11 because there is no biasing imparted by spring 15 upon the latch lever while cover 2 is open and the latch lever 20 is so designed and the pivot 11 so positioned that the biasing force of gravity urge the lever arm knob 12 rearwardly. Alternatively, or in combination, latch spring 19 can be used to urge latch 10 forwardly and lever arm knob 12 rearwardly. Reserve roll spindle 4 is slid upwardly in spindle flange channel 17 until latch 10 engages flange notch 9 to hold reserve roll spindle 4 in the storage zone position. The rearward biasing forces on latch 10 assure engagement of latch 10 with flange notch 9. An unused roll of bathroom tissue is then placed upon reserve roll spindle 4 and the cabinet cover 2 is closed and held closed by keeper 22 and latch spring 21. A locking arrangement (not shown) can be provided to lock the cabinet cover 2 in its closed position to prevent unauthorized opening of the cabinet cover 2.

Upon closing of cabinet cover 2, the spring 15 engages the end of push rod 14 and applies biasing force through push rod 14 and push rod arm 13 against lever arm knob 12 to press lever arm knob 12 against the end of primary roll 7. The biasing spring 15 is sufficiently strong to overcome the other biasing forces acting in the opposite direction on latch lever 20. The paper remaining on primary roll 7 prevents lever arm knob 12 from being moved sufficiently forward to disengage latch 10 from flange notch 9. When the tissue on the primary roll 7 is substantially exhausted, the spring 15 pushes lever arm knob 12 forward and disengages lever arm latch 10, which causes reserve roll spindle 4 to drop into its second position in the dispensing zone. Tissue can then be removed from the reserve roll 6.

If for some reason the lever arm jams and fails to automatically move upon depletion of the primary roll 7 tissue, the user can press release button 16 and exert additional force on the lever arm knob 12. However, any additional force exerted by the user is limited by the properties of spring 15, since the force must be transmitted through the spring 15. By properly choosing the spring constant of spring 15, the amount of force exertable upon lever arm knob 12 can be limited below that force which would compress the sheet material on roll 7, so that a user cannot prematurely drop the reserve roll 6 into the dispensing zone. This safeguard is particularly useful when bathroom tissue is the sheet material being dispensed, because it is soft and can be easily compressed.

While the preferred embodiment of the invention has been described, variations will be obvious to one skilled in the art. For example, the preferred form of the invention employs gravity to move the reserve roll spindle 4 from the storage zone to the dispensing zone, but spring biasing means could also be used. However, the use of gravity is the simplest and most economical means. Also, additional reserve rolls could be positionable in the storage zone, if desired, through use of additional spindles movably mounted above the first reserve roll spindle 4 and through use of similar holding means and release means.

I claim:

1. Apparatus for dispensing sheet material from a roll, comprising:

a cabinet having a dispensing zone from which the sheet material may be removed from its roll and a storage zone from which the sheet material cannot be removed from its roll;

a first spindle attached to the cabinet in the dispensing zone for holding a primary roll of the material;

a second spindle attached to the cabinet and movable from a first position in the storage zone to a second position in the dispensing zone, the second spindle for holding a reserve roll of the material and including a flange with a notch;

holding means for holding the second spindle in its first position in the storage zone, the holding means including a pivotably mounted latch lever arm engagable at its first end with the notch and engagable at its second end, opposite from the first, with the sheet material on the primary roll so that it is prevented by the existence of unused sheet material on the primary roll from moving sufficiently to release the first end of the latch lever arm from the notch;

means for moving the second spindle from its first position to the second position upon release of the holding means; and release means for releasing the holding means and permitting the second spindle to move to the second position only upon substantial depletion of the sheet material of the primary roll.

2. Apparatus according to claim 1, wherein: the second spindle is released upon a predetermined movement of the second end of the latch lever arm in a release direction, which movement is resisted by the sheet material remaining on the primary roll; and the release means comprises manual force means for manually applying a force to the second end of the latch lever arm in the release direction, the manual force means including a spring through which the force is applied, the spring having a constant so that the force which can be applied to the second end of latch lever arm is limited to an amount insufficient to cause the second end of the latch lever arm to comprsss the sheet material remaining on the primary roll and thereby release the holding means before substantial exhaustion of the sheet material on the primary roll.

3. Apparatus according to claim 1, wherein the second end of the latch lever arm engages the side end of the sheet material on the roll.

4. Apparatus according to claim 3, wherein the second spindle is mounted above the first spindle for movement in a vertical direction and the second spindle is urged from the first position to the second position by gravity.

5. Apparatus according to claim 4, wherein the second spindle moves from the first position to the second position through a spindle flange channel and the latch lever arm yieldingly blocks the channel and slows the movement of the second spindle to the second position.

6. Apparatus according to claim 1, wherein the release means are arranged to release the holding means automatically upon substantial depletion of the sheet material on the primary roll.

7. Apparatus according to claim 6, wherein the release means includes a spring urging the second end of the latch lever arm against the side end of the material on the roll.

8. Apparatus according to claim 7, wherein the first spindle is mounted in a fixed position.

9. Apparatus according to claim 8, wherein the release means spring acts upon the second end of the latch lever arm through a push rod which extends through the inside of the first spindle.

10. Apparatus for dispensing sanitary paper from a roll, comprising:

a cabinet having a dispensing zone from which paper may be removed from its roll and a storage zone from which paper cannot be removed from its roll;

first holding means for holding a primary roll of paper in the dispensing zone;

second holding means for holding a reserve roll of paper in the storage zone, the second holding means comprising a member which engages the paper on the primary roll and causes release of the reserve roll upon a predetermined movement of the member in a release direction, which movement is resisted by the paper on the primary roll;

means for moving the reserve roll from the storage zone to the dispensing zone upon release of the second holding means; and force means for manually applying a force to the member in the release direction, the force means including a spring through which the force is applied and which limits the force which can be applied to the member to an amount insufficient to cause the member to compress the paper remaining on the primary roll and thereby release the second holding means before substantial exhaustion of the sheet material on the primary roll.

11. Apparatus for dispensing sheet material from a roll, comprising:

a cabinet having a dispensing zone from which the sheet material can be removed from its roll and a storage zone from which sheet material cannot be removed from its roll;

a reserve roll spindle for holding a reserve roll of the material, the spindle being attached to the cabinet and movable from the storage zone to the dispensing zone;

holding means for engaging and holding the spindle in the storage zone, the holding means comprising first biasing means for urging the holding means into engagement with the spindle;

release means for releasing the holding means and permitting the spindle to move to the dispensing zone, the release means comprising second biasing means stronger than the first biasing means for urging the holding means out from engagement with the spindle; and a cabinet cover which can be opened to permit access to the spindle for positioning the spindle in the storage zone and placing a roll of the material on the spindle, the cover operably engaging the second biasing means when closed and disengaging the second biaisng means when opened, whereby the holding means engages the spindle when the spindle is positioned in the storage zone.

12. Apparatus for dispensing sheet material from a roll, comprising:

a cabinet having a dispensing zone from which the sheet material may be removed from its roll and a storage zone from which the sheet material cannot be removed from its roll;

a first spindle attached to the cabinet in the dispensing zone for holding a primary roll of the material, said first spindle being mounted in fixed position to the cabinet;

a second spindle attached to the cabinet and movable from a first position in the storage zone to a second position in the dispensing zone, the second spindle for holding a reserve roll of the material;

holding means for holding the second spindle in its first position in the storage zone, the holding means comprising a member which engages the sheet material on the primary roll and is operably connected with the second spindle to hold the second spindle in the storage zone and to release the second spindle upon a predetermined movement of the member in a release direction, which movement is resisted by the sheet material remaining on the primary roll;

means for moving the second spindle from its first position to the second position upon release of the holding means; and release means for releasing the holding means and causing the second spindle to move to the second position in response to substantial depletion of the sheet material on the primary roll.

13. Apparatus for dispensing sheet material from a roll, comprising:

a cabinet having a dispensing zone from which the sheet material may be removed from its roll and a storage zone from which the sheet material cannot be removed from its roll;

a first spindle attached in a fixed position to the cabinet in the dispensing zone for holding a primary roll of the material;

a second spindle attached to the cabinet and movable from a first position in the storage zone to a second position in the dispensing zone, the second spindle for holding a reserve roll of the material;

holding means for holding the second spindle in its first position in the storage zone;

means for moving the second spindle from its first position to the second position upon release of the holding means; and release means for releasing the holding means and permitting the second spindle to move to the second position only upon substantial depletion of the sheet material on the primary roll.

* * * * *